US006357535B1

(12) United States Patent
Lemon

(10) Patent No.: US 6,357,535 B1
(45) Date of Patent: Mar. 19, 2002

(54) SOIL SAMPLING APPARATUS

(76) Inventor: Richard A. Lemon, 14072 West Park Ave., Boulder Creek, CA (US) 95006

( * ) Notice: Subject to any disclaimer, the term of this patent is extended or adjusted under 35 U.S.C. 154(b) by 0 days.

(21) Appl. No.: 09/347,386

(22) Filed: Jul. 6, 1999

(51) Int. Cl.[7] ..... E21B 11/02
(52) U.S. Cl. ..... 175/20; 73/864.44
(58) Field of Search ..... 175/20; 73/864.44, 73/864.45

(56) References Cited

U.S. PATENT DOCUMENTS 3,696,873 A 10/1972 Anderson ..... 175/20
4,989,678 A 2/1991 Thompson ..... 175/20
5,343,771 A 9/1994 Turriff et al. ..... 73/864.44
6,164,935 A * 12/2000 Turiansky ..... 417/534

* cited by examiner

*Primary Examiner*—Thomas P. Noland
(74) *Attorney, Agent, or Firm*—Henry M. Stanley

(57) ABSTRACT

A soil sampler provides samples for on site disposition in forty and twenty milliliter vials for subsequent off site volatile organic analysis. A split sleeve contains a plunger positioned within the sleeve on a shaft to obtain a desired volume of soil when the sampler is thrust into the soil. An outer shell contains the split sleeve and a set screw device fixes the shaft and plunger in desired position within the sleeve. Metering marks on the shaft provide predetermined sample size indication.

13 Claims, 1 Drawing Sheet

SOIL SAMPLING APPARATUS

SUMMARY OF THE INVENTION

The invention described herein relates to apparatus for obtaining soil samples for reliable detection of volatile organics and hydrocarbon analysis. An external housing has a proximal end, a distal end, an exterior surface and an interior surface. A split sleeve has an outside surface configured for a sliding fit with the external housing interior surface and also has an inside surface. A shaft extends axially through and is spaced from the split sleeve inside surface and further has a proximal end and a distal end. A plunger is connected to the distal end of the shaft and is configured for a sliding fit with the split sleeve inside surface. Means is provided on the shaft proximal end for accessing and moving the shaft in axial position within the split sleeve. Means is also provided for adjustably fixing the shaft in axial position within the split sleeve.

In another aspect of the invention, apparatus is described for obtaining soil samples, which includes an external tubular housing having a housing passage therethrough, a distal end and a proximal end. A sleeve is configured to lie within the housing passage and has a distal end and a proximal end. The sleeve further has a sleeve passage therethrough. A flange is formed on the sleeve proximal end adjacent the external tubular housing proximal end. A shaft extends through the sleeve passage and has a shaft distal end and a shaft proximal end. A plunger is attached to the shaft distal end for axial movement and sliding fit within the sleeve passage. Means is provided for fixing the shaft in a plurality of axial positions within the sleeve.

In yet another aspect of the invention, soil-sampling apparatus is disclosed for obtaining samples for use in detection of volatile organic and hydrocarbon compounds. An exterior tubular housing has an open sampling end and a housing passage therethrough. A split sleeve is disposed in fixed position within the housing passage and has an open sampling end and a sleeve passage therethrough. A split flange is formed on the split sleeve abutting the exterior tubular housing at an end thereon opposing the open sampling end. A shaft extends through the sleeve passage and the split flange and is disposed for axial movement therein. A plunger is attached to the shaft and has a surface disposed for sliding fit within the sleeve passage from positions spaced from to positions proximate to the split sleeve open sampling end. Further, means is provided for adjustably fixing the shaft in axial position within the sleeve passage.

DESCRIPTION OF THE PREFERRED EMBODIMENT

Figures 1, 2, 3, 4:
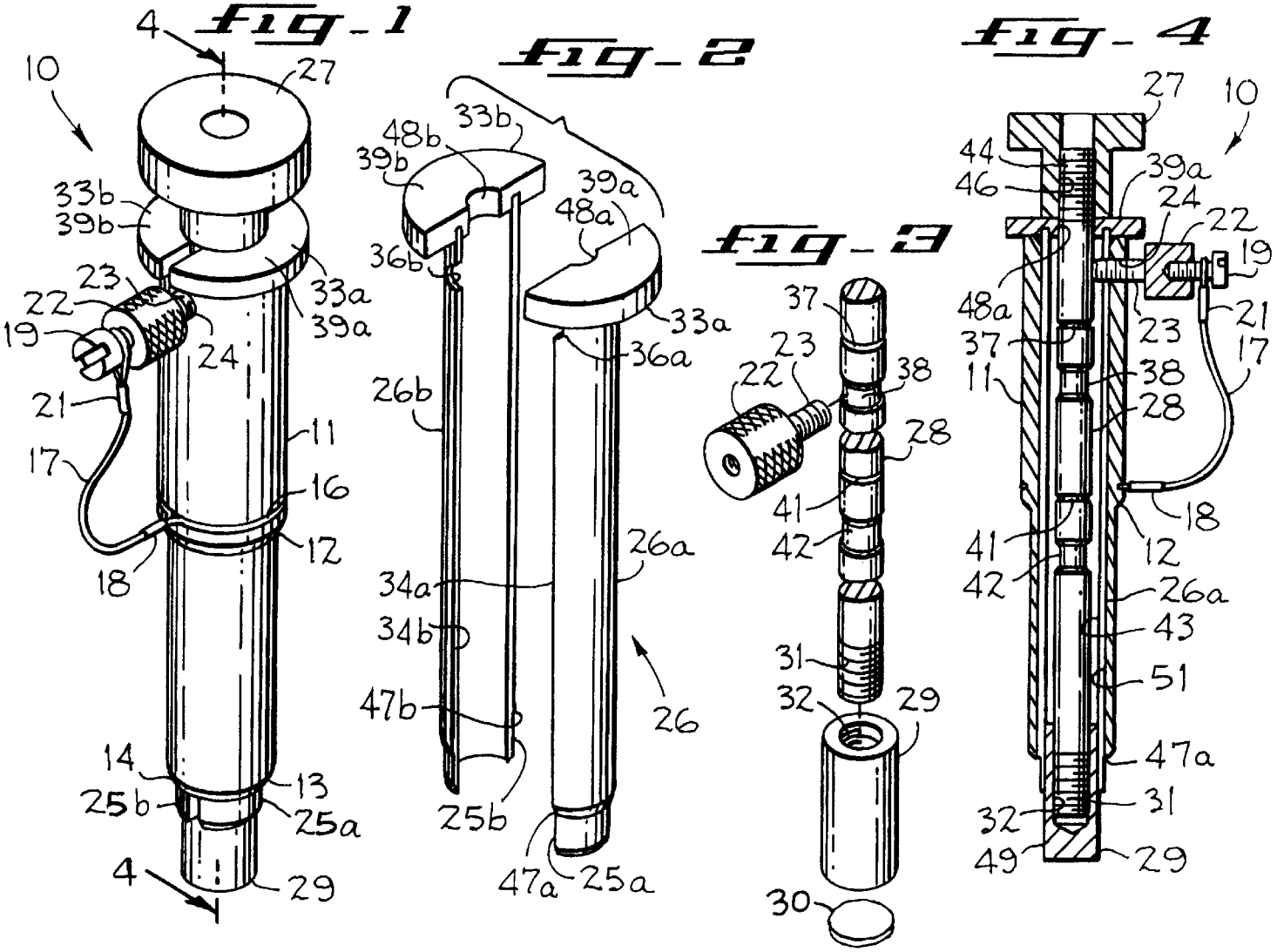
FIG. 1 is a perspective of an assembly of the present invention.
FIG. 2 is an exploded perspective of a split sleeve utilized in the present invention.
FIG. 3 is an exploded perspective of a shaft and plunger assembly utilized in the present invention.
FIG. 4 is a section along the line 4—4 of FIG. 1.

Investigations have shown that it is difficult if not impossible to get reliable soil samples for volatile organics and hydrocarbons analysis from a conventional brass ring preserved soil sample. Such a soil sample is obtained through the use of the device shown in U.S. Pat. No. 5,343,771, Turriff et al. Soil samplers to provide reliable samples at the site of the sampling should be configured to extract a known volume of sample from the soil being analyzed and afford easy transfer of the soil sample to a secure container for transfer to the analysis laboratory. Ideally, the sampler should provide no contamination and admit no contamination to the sample, should be rugged in construction for on site use and should be easy to clean between samples. Further, the sampler should be able to readily transfer the soil sample to a forty milliliter or twenty milliliter vial at the site of the sampling so that the vials may be transferred to a laboratory for performance of purge and trap sampling. Volatiles should not be lost in the transfer step or inaccurate data will result.

Certain EPA testing protocols have recently been implemented which require sample collecting of a specific volume of soil followed by deposit of the soil sample into specified sizes of storage vials for transfer to laboratories for analysis. The invention disclosed herein relates to acquisition of soil samples for on site transfer to 40 milliliter and 20 milliliter vials which are sealed and then transferred to the laboratories. FIG. 1 shows the soil sampler 10 in assembled condition having an exterior housing 11 with a shoulder 12 located about midway along the axial length of the exterior housing. The exterior housing has a distal end 13 with a chisel-like edge 14 at the distal end. A thin groove 16 has a thin cable 17 wrapped therearound and secured with a crimped bushing 18. The opposing end of the thin cable 17 is wrapped around a screw 19 and secured to the screw with another crimped bushing 21. The screw 19 engages threads formed in the top of a knurled set screw 22 which has a threaded shank 23 configured to engage threads in a threaded hole 24 which is axially oriented in the external housing 11.

A split sleeve shown generally at 26 in FIG. 2 has two half sleeves 26*a* and 26*b*, the distal ends 25*a* and 25*b* of which are shown extending from the distal end 13 of the external housing 11 in FIG. 1. A knob or handle 27 is shown in FIG. 1 at the proximal end of the sampler 10 which is attached by means of a shaft 28 (FIG. 3) to a plunger 29 (FIGS. 1 and 3). The shaft 28 extends through a passage 43 within the half sleeves 26*a* and 26*b* and has a threaded distal end 31 which mates with a threaded hole 32 in the proximal end of the plunger 29. The distal end of the plunger 29 is shown extending from the distal ends 25*a* and 25*b* of the split sleeve 26 in FIG. 1. A thin teflon disc 30 is shown in FIG. 3, which is placed against the distal end of plunger 29 when the plunger is withdrawn axially into the split sleeve 26 preparatory to obtaining a predetermined volume of soil for a sample as hereinafter described. The thin disc 30 has a diameter that fits snugly within the inside diameter of the assembled split sleeve 26. The thin disc prevents grit from becoming embedded in the end of the plunger 29 and further inhibits migration of grit or other foreign matter between the outside diameter of the plunger and the inside diameter of the split sleeve. This prevents scoring of both parts and prevents contamination of the plunger distal end and analyte carryover.

The split sleeve 26 (FIG. 2) has a split flange shown at 33*a* and 33*b* which is fixed, as by brazing, to the proximal ends of the split sleeve portions 26*a* and 26*b*, respectively. The split sleeve portions have adjacent edges 34*a* and 34*b* (FIG. 2) when assembled. A hole is formed through the edges 34*a* and 34*b* of the split sleeve having hole halves 36*a* and 36*b* as also seen in FIG. 2. The hole halves 36*a* and 36*b* form a through hole in the side of the assembled split sleeves 26*a* and 26*b* allowing passage of the tip of the threaded portion 23 on set screw 22, so that the tip of the threaded portion 23 may contact the surface of the shaft 28. Shaft 28 has a narrow groove 37 formed in the periphery thereof which is spaced from a wider groove 38 around the periphery of the shaft. The split flange 33*a* and 33*b* has a flat surface thereon shown at 39*a* and 39*b*. When the shaft 28 is positioned axially within the split sleeve assembly 26*a* and 26*b* so that the groove 37 is aligned with the flat surface formed by 39*a* and 39*b*, the wide groove 38 is positioned directly beneath the tip of the threaded portion 23 on the set screw 22. In this fashion, the plunger 29 is drawn a predetermined distance from the distal end of the split sleeve assembly and fixed in this position by the set screw 22. This predetermined distance provides for a volume between the distal end of the plunger 29 and the distal ends 25*a* and 25*b* of the split sleeve assembly 26. Thus, a predetermined volume is obtained which will fit into a vial, thereby providing a defined sample size.

As described hereinbefore for thin groove 37 and wider groove 38, another thin groove 41 is shown in the periphery of the shaft 28 spaced a predetermined distance from another wide groove 42 in the periphery of the shaft. When the handle 27 is drawn away from the distal end of the sampler 10 until the narrow groove 41 appears aligned with the flat surfaces 39*a* and 39*b*, the wide groove 42 is disposed directly underneath the tip of the threaded portion 23 on the set screw 22. Therefore, when the set screw 22 is advanced to contact the surface of the groove 42 the shaft 28 is locked axially in place. The plunger 29 is thus withdrawn from the distal end of the sampler 10 to provide a volume between the distal end 25*a* and 25*b* of the split sleeve assembly and the distal end of the plunger 29 which is sufficient to be deposited within a predetermined size sample vial.

With reference now to FIG. 4, an amplifying description of the relative positions of the various parts of the soil sampler 10 will be undertaken. The shaft 28 is seen to be centrally located within the passage 43 extending axially along the length of the split sleeve assembly presented by the split sleeve half 26*a*. The shaft threaded portion 31 is configured to engage threads in hole 32 in plunger 29. The shaft also has a threaded portion 44 on the proximal end thereof which is configured to engage threads 46 in knob or handle 27. Plunger 29 can thus be manipulated axially within the through passage 43 to occupy any desired position therealong. The plunger 29 is seen in both FIGS. 1 and 4 extended as far as possible toward the distal end of the soil sampler 10. As described hereinbefore in conjunction with FIG. 3, the handle 27 may be drawn upwardly in FIG. 4 to align the thin groove 27 with the upper surface 39*a* so that the wide groove 38 is positioned directly beneath the tip of the threaded portion 23 of the set screw 22. The thin disc 30 may then be placed within the split sleeve 26 in position to overly the distal end of the plunger 29. As a result, the plunger 29 is drawn upwardly in FIG. 4 a predetermined distance from the distal end of the soil sampler and fixed there in position so that the aforementioned predetermined volume of soil sample is obtained when the distal end of the soil sampler is forced into the ground at the sampling site. The volume of the soil sample obtained in this manner may be appropriate for insertion into a twenty milliliter sample vial, for example. A shoulder 47*a* in FIG. 4 (47*a* and 47*b* in FIG. 2) is formed near the distal ends 25*a* and 25*b* of the two split sleeve halves 26*a* and 26*b*. The twenty milliliter vial for receiving the soil sample has an upper opening with a lip surrounding the opening. The shoulder 47*a* (and 47*b*) is sized to contact the lip of the twenty milliliter vial and prevent insertion of the soil sampler 10 further into the interior of the vial. Consequently, the soil is freely deposited into the vial by pushing the handle 27 downwardly to eject the sample. In similar fashion, when the narrow groove 41 is aligned with the surface 39*a* (FIG. 4) the wide groove 42 is disposed beneath the tip of the threaded portion 23 of the set screw 22 and the shaft is fixed in position by the set screw when the threaded portion is advanced to seat against the periphery of the groove 42. The result is that the distal end of the plunger 29 is positioned within the passage 43 farther from the distal end of the split sleeve assembly so that a larger soil sample is obtained within the passage 43 when the distal end of the soil sampler 10 is thrust into the soil surface at the sampling site. When the soil sampler is withdrawn from the soil surface with the sample contained inside the passage 43, the sampler's distal end is inserted into an upper opening in a larger vial, i.e., a forty milliliter vial, having a surrounding lip at the opening. The sampler entry into the vial is limited by contact between the vial lip and the shoulder 12 on the external housing 11. The sample is deposited within the vial by pushing the handle 27 down to expel the soil sample from the distal end of the passage 43. It should be noted that the shaft 28 is held centrally located within the passage 43 by the plunger 29 and a hole 48*a* (and 48*b* as seen in FIG. 2) in the flange halves 33*a* and 33*b*, respectively. It should also be noted that the sampler is designed to be held in one hand while pushing handle 27 with fingers on the same hand to expel the sample. The receiving vial may be held by the other hand. This facilitates sample taking, sample isolation and sample containment at the sampling site.

When a sample is taken, it is desirable to clean the sampler to avoid contamination of subsequent samples. The set screw 22 is backed out of the threaded hole 24 in the external housing 11 and is therefore removed from the half holes 36*a* and 36*b* in the split sleeve 26. The split sleeve and shaft assembly is removable through the upper portion of the external housing 11 as seen in FIG. 4 and the split sleeve portions are separated from the shaft and plunger. The thin disc 30 is deposited in the vial with the sample and is replaced with a new disc when the soil sampler is used to obtain a subsequent sample. All surfaces on all other parts of the sampler assembly are thereby readily accessible for thorough cleaning prior to reassembly for subsequent sample taking.

In addition, it should be noted that plunger 29 has an outer surface 49 which has a low static and dynamic friction coefficient characteristic. This feature may be obtained through the use of Teflon material for the plunger 29 or through the use of a Teflon coated plunger in the best mode of the invention. It is envisioned, however, that other means, materials and configurations may be utilized to obtain the low friction coefficient on the outer surface 49 of the plunger 29. The low coefficient of friction characteristic between the outer surface 49 of the plunger and the surface of the passageway 43 is desirable because a sliding fit is necessary between these two surfaces. If debris was allowed to migrate between the surfaces 49 and 43, binding between the plunger and the split sleeve assembly would occur causing rapid degradation of the soil sampler 10 and possible loss of volatiles from the sample. It should also be noted that in the best mode of the invention a relatively close fit is desirable between the outer surface of the split sleeve assembly 26 and the inner surface 51 (FIG. 4) of the external housing 11. Although these surfaces are not required to move relative to one another during operation of the soil sampler, it is still desirable to prevent migration of debris between them as much as possible. Cleansing of the parts following the taking of a sample and disassembly will remove any debris that has been able to intervene between these two surfaces.

A soil sampler is disclosed herein which quickly and consistently produces uniform soil samples and which is operable with one hand to deposit the samples immediately into appropriate sample containers on the site of the sampling without contaminating the sample or losing analytes.

Although the best mode contemplated for carrying out the present invention has been shown and described herein, it will be understood that modification and variation may be made without departing from what is regarded to be the subject matter of the invention.

What is claimed:

1. Apparatus for obtaining soil samples, comprising an external tubular housing having a housing passage therethrough, a distal end and a proximal end, a sleeve configured to lie within said housing passage and having a distal end and a proximal end, said sleeve further having a sleeve passage therethrough, a flange on said sleeve proximal end adjacent said external tubular housing proximal end, a shaft extending through said sleeve passage and having a shaft distal end and a shaft proximal end, a plunger attached to said shaft distal end for axial movement and sliding fit within said sleeve passage, and means for fixing said shaft in a plurality of axial positions within said sleeve.

2. Apparatus as in claim 1, comprising means for indicating said shaft axial positions.

3. Apparatus as in claim 2 wherein said means for indicating comprises meter marks on said shaft observable at said flange.

4. Apparatus as in claim 3 wherein said shaft comprises surface features thereon for cooperation with said means for fixing, said surface features being in predetermined axial relationship with said meter marks for obtaining predetermined sample size.

5. Apparatus as in claim 1 wherein the soil samples are intended to be deposited in predetermined volume vials having an upper opening and a lip, said apparatus further comprising a shoulder on said external tubular housing for contacting the vial lip and limiting entry of said external tubular housing and sleeve distal ends through the vial upper opening.

6. Apparatus as in claim 1 wherein the soil samples are intended to be deposited in predetermined volume vials having an upper opening and a lip, said apparatus further comprising a shoulder on said sleeve distal end for contacting the vial lip and limiting entry of said external tubular housing and sleeve distal ends through the vial upper opening.

7. Apparatus as in claim 1 wherein said sleeve comprises a split sleeve, and wherein said flange comprises a split flange, whereby disassembly and cleaning after use is facilitated.

8. Apparatus as in claim 1 wherein said plunger has an outside surface, a proximal end and a distal end, comprising means on said plunger outside surface for providing a low coefficient of sliding friction, and a thin disc for positioning overlying said plunger distal end when obtaining soil samples.

9. Apparatus as in claim 1, comprising a chisel edge on said external tubular housing distal end.

10. Soil sampling apparatus for obtaining samples for use in detection of volatile organic and hydrocarbon compounds, comprising an exterior tubular housing having an open sampling end and a housing passage therethrough, a split sleeve disposed in fixed position within said housing passage and having an open sampling end and a sleeve passage therethrough, a split flange on said split sleeve abutting said exterior tubular housing at an end thereon opposing said open sampling end, a shaft extending through said sleeve passage and said split flange disposed for axial movement therein, a plunger attached to said shaft and having a surface disposed for sliding fit within said sleeve passage from positions spaced from, to positions proximate, to said split sleeve open sampling end, and means for adjustably fixing said shaft in axial position within said sleeve passage.

11. Soil sampling apparatus as in claim 10, comprising means for indicating axial position of said shaft and therefore soil sample size.

12. Soil sampling apparatus as in claim 10 wherein said surface on said plunger comprises means for providing a low static and sliding coefficient of friction.

13. Soil sampling apparatus as in claim 10, wherein said plunger has a distal end and a proximal end, comprising a thin disc configured to fit within said sleeve passage overlying said plunger distal end when said plunger is spaced from said split sleeve open sampling end.

* * * * *